US005110446A

United States Patent [19]

Harandi et al.

[11] Patent Number: 5,110,446

[45] Date of Patent: May 5, 1992

[54] INTEGRATED PRODUCTS SEPARATION FROM FLUID CATALYTIC CRACKING AND AROMATIZATION PROCESSES

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 579,417

[22] Filed: Sep. 7, 1990

Related U.S. Application Data

[63] Continuation-in-part of Ser. No. 310,487, Feb. 14, 1989, abandoned, which is a continuation of Ser. No. 122,726, Nov. 18, 1987, abandoned.

[51] Int. Cl.[5] ..... C10G 57/00

[52] U.S. Cl. ..... 208/100; 208/49; 208/70; 208/92; 208/93; 208/94; 208/103; 208/134; 208/135; 585/300; 585/315; 585/314; 585/322; 585/413

[58] Field of Search ..... 208/70, 100, 103, 105, 208/92, 93, 94; 585/300, 315, 322, 413, 314

[56] References Cited

U.S. PATENT DOCUMENTS 2,456,338 12/1948 Stadtherr ..... 585/300
4,950,387 8/1990 Harandi et al. ..... 208/70

*Primary Examiner*—Helane E. Myers
*Attorney, Agent, or Firm*—Alexander J. McKillop; Charles J. Speciale; Robert B. Furr, Jr.

[57] ABSTRACT

The present invention provides a process for decreasing the energy consumption of a catalytic cracking process product recovery section while improving gasoline yield by integrating multistage vapor compression and product recovery with deacidification and conversion of $C_2$–$C_4$ aliphatics to $C_5$+ normally liquid hydrocarbons.

12 Claims, 1 Drawing Sheet

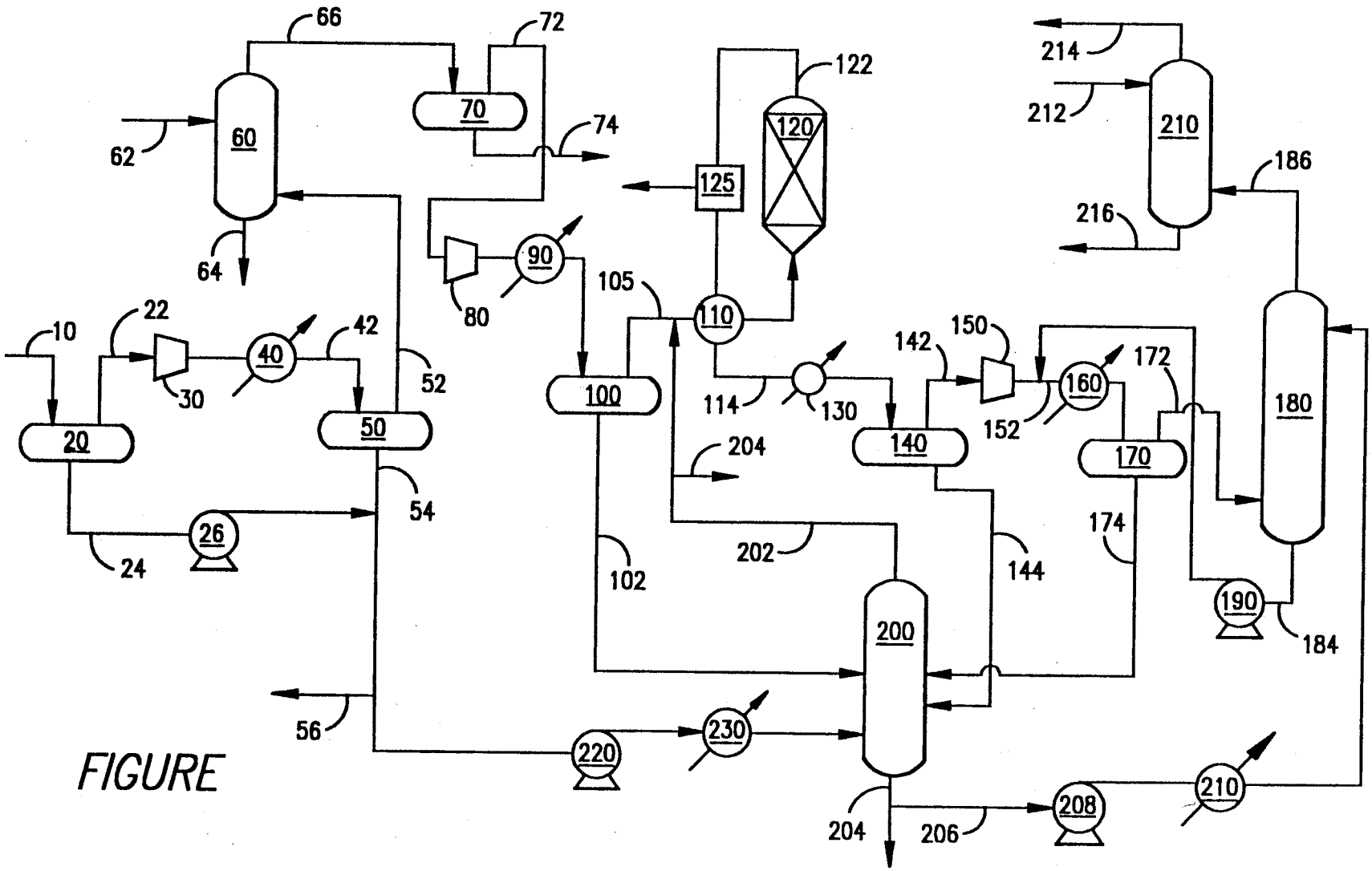
FIGURE

INTEGRATED PRODUCTS SEPARATION FROM FLUID CATALYTIC CRACKING AND AROMATIZATION PROCESSES

CROSS-REFERENCE TO RELATED APPLICATIONS

This application is a continuation-in-part of application Ser. No. 310,487, filed Feb. 14, 1989, now abandoned, which is a continuation of application Ser. No. 122,726, filed Nov. 18, 1987, now abandoned. The entire contents of application Ser. No. 310,487 are incorporated by reference as if set forth at length herein.

FIELD OF THE INVENTION

The present invention relates to a process for producing high octane gasoline from light olefinic streams produced in a catalytic cracking process. More specifically, the invention relates to an integrated three-stage process which includes a first catalytic cracking stage, a second intermediate product deacidification and fractionation stage, and a third intermediate product upgrading stage.

BACKGROUND OF THE INVENTION

The advent of more stringent environmental regulations together with the ever increasing demand for high octane gasoline, has prompted refiners to seek energy efficient methods for maximizing gasoline octane and yield. Process integration, or coupling of chemical conversion processes, has gained wide acceptance in the refining industry as a means for improving product volume and quality while decreasing energy consumption. The benefits, however, are not without drawbacks, which include loss of process unit flexibility if two or more conversion processes must be operated concurrently or not at all.

Processes for upgrading heavier petroleum crude fractions to more saleable distillate and gasoline fractions include catalytic and thermal cracking. These processes convert a gas oil or heavier cut from a crude feedstock to the desired distillate and gasoline fractions, but a portion of the crude feedstock is also cracked to lighter fractions such as $C_4-$aliphatics, which are less valuable than the heavier distillate and gasoline products.

Catalytic cracking processes manufacture a major segment of the total gasoline pool produced in modern oil refineries by upgrading gas oil and heavier feedstreams to a lighter product slate including gasoline and distillate as well as $C_4-$aliphatics rich in olefins. Examples of such catalytic cracking processes are described in P. B. Venuto and E. T. Habib, Jr., *Fluid Catalytic Cracking with Zeolite Catalysts* (1979) as well as U.S. Pat. Nos. 2,383,686 to Wurth, 2,689,210 to Leffer, 4,093,537 to Gross et al., 4,118,338 to Gross et al., and 4,411,773 to Gross, which patents are incorporated by reference herein.

To increase the overall yield of high octane gasoline from catalytic cracking units, processes have been developed which upgrade the $C_4-$byproducts of the cracking process. With the advent of these light aliphatics upgrading processes, the demands on the catalytic cracking unit product fractionation section have also changed. Specifically, the $C_4-$aliphatics upgrading processes operate at relatively high temperature conditions, typically above about 800° F. For this reason, the $H_2$, $H_2S$, and mercaptan sulfur contents of the $C_4-$aliphatic streams from the catalytic cracking unit product fractionation section are critical, not only to meet product specifications and to prevent accelerated catalyst deactivation, but also to assure safe and reliable unit operation using the most economical materials of construction. It has been found that levels of $H_2S$, $H_2$, and mercaptan sulfur levels which were completely acceptable for lower temperature light aliphatics upgrading processes such as HF or $H_2SO_4$ catalytzed alkylation can markedly accelerate corrosion, pitting and cracking in carbon steel and lower alloy vessels under the more severe temperature conditions associated with the catalytic upgrading processes presently under consideration. Thus it would be desirable to provide the light aliphatics upgrading process associated with the catalytic cracking unit with a $C_2$–$C_4$ aliphatic stream which is relatively free from $H_2S$, $H_2$, and mercaptan sulfur.

Catalytic cracking process units typically include a main fractionator, commonly called the main column, which receives cooled reactor effluent from the catalytic cracking process. The main column fractionates this reactor effluent into a plurality of streams including clarified slurry oil, heavy cycle oil, light cycle oil, light and heavy distillates, gasoline and an overhead gas stream rich in $C_4-$olefins. The gasoline and lighter components are then further fractionated in an unsaturated gas plant which typically includes, in order, a deethanizer absorber, a debutanizer and a depropanizer.

The deethanizer absorber splits the gasoline and lighter material into a $C_2-$overhead gas stream and a $C_3+$bottoms stream. The $C_2-$overhead gas stream may optionally be treated in a sponge absorber to further sorb $C_3+$components before acidic components such as hydrogen sulfide, carbon dioxide and hydrogen cyanide are removed in a purification sorption column. Having been treated to reduce its acidic gas content, the deethanizer absorber overhead stream is then charged to a fuel gas header to be burned for fuel in the refinery complex.

The deethanizer absorber bottom stream is then charged to a debutanizer fractionator where it is split into a $C_5+$gasoline stream rich in olefinic components and a $C_3$–$C_4$ overhead stream. The debutanizer fractionator is typically designed to meet a bottom stream gasoline volatility specification requiring vapor pressure of less than about 10 psi. Finally, the debutanizer overhead stream, rich in $C_3$–$C_4$ olefins, may be fractionated into a propane/propylene overhead stream and a butane/butylene bottoms stream. This step is most often employed when additional light aliphatics upgrading capacity is available, for example, an alkylation process unit for converting iso- and normal $C_4-$aliphatics to high octane alkylate gasoline. The $C_3-$rich depropanizer or debutanizer overhead stream may be sold as LPG, but first must be treated in a mercaptan sulfur removal process to meet sulfur content specifications. One example of such a process is the Merox process (trademark and/or service mark of UOP, Inc.).

The incremental volume of $C_2-$fuel gas generated by a catalytic cracking process may increase the total refinery fuel gas volume beyond that needed to fulfill its fuel gas consumption and sales requirements. To assure compliance with environmental regulations governing content and volume of gases exhausted to the atmosphere, fuel gas production is limited to the total volume which can be consumed within the refinery, sold to consumers beyond the battery limits of the refinery, or flared in accordance with the applicable environmental permits. Thus if the incremental volume of fuel gas generated by the catalytic cracking unit exceeds the capacity of facilities for its disposition, the cracking unit feedrate or reaction severity must be reduced. Neither option is economically desirable. The ideal solution would be to decrease fuel gas volume by shifting the overall yield from the catalytic cracking unit away from $C_2-$components and toward more valuable high octane $C_5+$gasoline. The acid gas components of the catalytic cracking unit reactor effluent stream tend, however, to be carried with ethane and ethylene. This is a major obstacle to successfully integrating the aliphatics upgrading process with the catalytic cracking process. Clearly, then, the problem of excess fuel gas production cannot be solved merely by shifting the cut points in a conventional catalytic cracking product fractionation section because the downstream light aliphatics upgrading process would be exposed to hydrogen and acid gases under severe temperature conditions.

A number of acid gas removal processes are commercially available for treating this overhead stream including chemical solvent as well as physical sorption processes. Chemical solvent techniques include countercurrent contacting with monoethanolamine (MEA), diethanolamine (DEA) and hot potassium carbonate. Physical sorption techniques employ solid sorbents such as molecular sieves, actiated charcoal and iron sponge.

Conventionally, these acid gas removal processes are installed downstream of the sponge absorber and debutanizer. Consequently, the acid gases are carried through the various upstream separation processes of the USGP including the absorber-deethanizer, sponge absorber and debutanizer. This configuration tends to increase the rate of acid gas induced corrosion of a large portion of the vessels and ancillary equipment in the USGP, leading to increased maintenance operations and plant downtime. Under the more severe temperature conditions of catalytic aliphatics upgrading processes, streams containing these acidic components readily attack carbon steel and the lower chromium- and molybdenum-containing steel alloys, and may cause cracking, pitting, blistering, or general thinning.

Catalytic aromatization converts the light aliphatics over a catalyst, for example,a medium-pore zeolite catalyst such as ZSM-5, to a product mixture rich in aromatics. Oligomerization and olefin interconversion may employ similar catalysts, but are typically conducted under less severe temperature conditions.

Thus it is clear that a process for shifting product yield in a catalytic cracking unit away from $C_4-$light aliphatics, particularly $C_2-$fuel gas, to favor production of high octane gasoline would provide substantial operational and economic benefits. Further, it would be desirable to provide the light olefin upgrading section of such a process with a feedstock of sufficient purity to meet the application environmental standards and product quality specifications while also avoiding the incremental capital costs associated with alloyed process equipment. Still further, it would be beneficial to segregate the various processing steps according to their respective operating pressure requirements to avoid energy losses due to unnecessary pressure drops in the catalytic cracking process product fractionation section.

SUMMARY OF THE INVENTION

The present inventive process integrates a catalytic cracking stage, an intermediate product deacidification/fractionation stage, and an intermediate product upgrading stage to increase $C_5+$gasoline volume and octane number while avoiding the acid gas handling problems which would normally be associated with catalytically upgrading this cracked product stream. Further, the process avoids unnecessary pressure differentials in the catalytic cracking unit product fractionation and recovery section by effecting deacidification and aliphatics upgrading downstream of a first vapor compression stage. Higher pressure absorption/stripping and optional sponge absorbption stages are then conducted downstream of a subsequent compression stage. The deacidification step may treat the total first vapor compression stage effluent or may optionally treat only a vapor fraction of the first vapor compression stage effluent which is enriched in acid gases and $C_4-$hydrocarbons.

Moreover, by shifting yield away from $C_4-$gas toward $C_5+$liquid, fuel gas as well as LPG production are beneficially decreased, thus minimizing the effects of refinery fuel gas volume limitations on the catalytic cracking process while also decreasing LPG mercaptan sulfur removal treatment costs. Further, the present process limits the concentrations of $H_2S$, $H_2$, $N_2$, and mercaptan sulfur flowing to the product fractionation section as a whole, including the light aliphatics upgrading reaction zone to minimize the use of nickel- and chromium-alloyed process equipment. Still further, the present integrated process limits the flow of these undesirable acid gas constituents to the light aliphatics upgrading reaction zone without sacrificing process flexibility.

The invention provides in a first method aspect, a technique for improving the gasoline product yield in a catalytic cracking process comprising the steps of:

(a) catalytically cracking a hydrocarbon feedstock containing gas oil or heavier fractions to a cracked product stream containing distillate, gasoline, lighter boiling range hydrocarbon fractions, and $H_2S$, $CO_2$, or both $H_2S$ and $CO_2$;

(b) providing a product fractionation section for separating and recovering gasoline and lighter components from said product stream, said product fractionation section including a primary cracked product separation zone, a multistage compressor, and a central debutanizer separator;

(c) flowing a stream containing cracked gasoline and lighter boiling hydrocarbons withdrawn from an upper section of said primary cracked product separation zone to a first accumulation zone to provide a vapor stream enriched in $C_4-$cracked hydrocarbons containing $H_2S$, $CO_2$, or both $H_2S$ and $CO_2$, and a liquid stream enriched in $C_5+$hydrocarbons;

(d) compressing said vapor stream of step (c) in a first stage of said multistage compressor of step (b) to evolve a deacidification charge stream;

(e) deacidifying said deacidification charge stream of step (d) by countercurrently contacting said vapor deacidification charge stream in a first sorption zone with an acid sorbent whereby said acid sorbent becomes enriched in $H_2S$, $CO_2$, or both $H_2S$ and $CO_2$;

(f) withdrawing a deacidified stream enriched in $C_4$−cracked hydrocarbons from said first sorption zone and flowing said deacidified stream to a second accumulation zone;

(g) contacting a deacidified vapor stream withdrawn from said second accumulation zone of step (f) with a catalyst comprising a zeolite under conversion conditions to convert $C_4$−cracked hydrocarbon products to a reactor effluent stream containing gasoline boiling range constituents including aromatics;

(h) cooling and at least partially condensing said reactor effluent stream and flowing said cooled reactor effluent stream to a third accumulation zone;

(i) compressing a vapor stream withdrawn from said third accumulation zone in a second stage of said multistage compressor of step (b);

(j) cooling said second stage compressor effluent of step (i) to at least partially condense said second stage compressor effluent;

(k) flowing said at least partially condensed second stage compressor effluent to a fourth accumulation zone to separate said at least partially condensed second stage compressor effluent into a vapor stream enriched in $C_3$−components and a liquid stream containing $C_4$+components;

(l) charging liquid product streams from said first accumulation zone, said second accumulation zone, said third accumulation zone, and said fourth accumulation zone to said central debutanizer separator to separate said liquid product streams into a central debutanizer overhead stream enriched in $C_4$−components and a bottom stream enriched in $C_5$+gasoline boiling range components; and (m) flowing a portion of said central debutanizer bottom stream to a second sorption zone to countercurrently sorb $C_3$+components from said fourth accumulation zone overhead stream of step (1) and recycling said sorbed $C_3$+components to said product fraction section upstream of said fourth accumulation zone.

The invention provides in a second method aspect, a technique for improving the gasoline product yield in a catalytic cracking process comprising the steps of:

(a) catalytically cracking a hydrocarbon feedstock containing gas oil or heavier fractions to a cracked product stream containing distillate, gasoline, lighter boiling range hydrocarbon fractions, and $H_2S$, $CO_2$, or both $H_2S$ and $CO_2$;

(b) providing a product fractionation section for separating and recovering gasoline and lighter components from said product stream, said product fractionation section including a primary cracked product separation zone, a multistage compressor, and a central debutanizer separator;

(c) flowing a stream containing cracked gasoline and lighter boiling hydrocarbons withdrawn from an upper section of said primary cracked product separation zone to a first accumulation zone to provide a vapor stream enriched in $C_4$−cracked hydrocarbons containing $H_2S$, $CO_2$, or both $H_2S$ and $CO_2$, and a liquid stream enriched in $C_5$+hydrocarbons;

(d) compressing said vapor stream of step (c) in a first stage of said multistage compressor of step (b);

(e) cooling said first stage compressor effluent of step (d) to at least partially condense said first stage compressor effluent;

(f) flowing said at least partially condensed first stage compressor effluent to a second accumulation zone to provide a vapor deacidification charge stream containing $H_2S$, $CO_2$, or both $H_2S$ and $CO_2$, and a second accumulation zone liquid stream enriched in $C_4$+hydrocarbons;

(g) deacidifying said vapor deacidification charge stream of step (f) by countercurrently contacting said vapor deacidification charge stream in a first sorption zone with an acid sorbent whereby said acid sorbent becomes enriched in $H_2S$, $CO_2$, or both $H_2S$ and $CO_2$;

(h) withdrawing a deacidified vapor stream enriched in $C_4$−cracked hydrocarbons from first sorption zone and flowing said deacidified vapor stream to a third accumulation zone;

(i) contacting said deacidified vapor stream of step (h) with a catalyst comprising a zeolite under conversion conditions to convert $C_4$−cracked hydrocarbon products to a reactor effluent stream containing gasoline boiling range constituents including aromatics;

(j) cooling and at least partially condensing said reactor effluent stream and flowing said cooled reactor effluent stream to a fourth accumulation zone;

(k) compressing a vapor stream withdrawn from said fourth accumulation zone in a second stage of said multistage compressor of step (b);

(l) cooling said second stage compressor effluent of step (k) to at least partially condense said second stage compressor effluent;

(m) flowing said at least partially condensed second stage compressor effluent to a fifth accumulation zone to separate said at least partially condensed second stage compressor effluent into a vapor stream enriched in $C_3$−components and a liquid stream containing $C_4$+components;

(n) charging liquid product streams from said first accumulation zone, said second accumulation zone, said fourth accumulation zone, and said fifth accumulation zone to said central debutanizer separator to separate said liquid product streams into a central debutanizer overhead stream enriched in $C_4$−components and a bottom stream enriched in $C_5$+gasoline boiling range components; and (o) flowing a portion of said central debutanizer bottom stream to a second sorption zone to countercurrently sorb $C_3$+components from said fifth accumulation zone overhead stream of step (m) and recycling said sorbed $C_3$+components to said product fraction section upstream of said fifth accumulation zone.

In an apparatus aspect, the invention provides process equipment for compressing and recovering cracked hydrocarbon products from a catalytic cracking process effluent stream containing gasoline boiling range and lighter hydrocarbons comprising:

(a) a first flash zone for separating hydrocarbon vapor from liquid hydrocarbons contained in said catalytic cracking process effluent stream;

(b) a first compression stage operatively connected to said first flash zone for imparting sufficient pressure to said hydrocarbon vapor to effect downstream separation and catalytic conversion of said hydrocarbon vapor to normally liquid hydrocarbons;

(c) a first compression stage effluent heat exchanger for cooling compressed hydrocarbon vapor effluent from said first compression stage, said first compression stage heat exchanger being operatively connected to, and positioned downstream from, said first compression stage;

(d) a second flash zone operatively connected to said first compression stage effluent heat exchanger for separating a cooled, compressed hydrocarbon vapor overhead stream from a hydrocarbon liquid bottom stream;

(e) an interstage deacidification zone for contacting said compressed hydrocarbon vapor overhead stream with an acid sorbent whereby acid gases are removed from said compressed hydrocarbon vapor overhead stream;

(f) a compressor interstage reactor containing a catalyst for converting deacidified $C_4-$hydrocarbons withdrawn from said interstage deacidification zone, said compressor interstage reactor operatively connected to receive at least a portion of the deacidified hydrocarbon vapor overhead stream from said second flash zone;

(g) a third flash zone downstream from said compressor interstage reactor for receiving reactor effluent product from said compressor interstage reactor;

(h) a second compression stage for receiving overhead vapor product from said third flash zone said first compression stage having capacity to impart sufficient pressure to said hydrocarbon vapor to effect downstream fractionation of said compressed hydrocarbon vapor;

(i) a fourth flash zone downstream from said second compression stage for receiving compressed hydrocarbon vapor from said second compression stage;

(j) a separator for collecting the liquid effluent withdrawn from each of said first, said second, said third, and said fourth flash zones and for separating said liquids streams into an overhead stream containing $C_4-$hydrocarbons and a bottom stream containing $C_5+$gasoline including aromatics; and (k) an absorber for countercurrently contacting at least a portion of said separator bottom stream containing $C_5+$gasoline stream with a hydrocarbon vapor overhead stream withdrawn from said fourth flash zone.

DESCRIPTION OF THE DRAWING

The Figure is a simplified schematic showing the major processing steps of one embodiment of the present invention.

DESCRIPTION OF THE EMBODIMENT

The present process integrates catalytic cracking and its associated cracked product fractionation section with deacidification and catalytic upgrading steps to increase liquid gasoline product octane and yield while minimizing the detrimental effects of acid gases on catalyst activity and process equipment longevity. More specifically, the present process both integrates and segregates the product fractionation section of a catalytic cracking producess to lower capital and operating costs improve energy efficiency. The process integrates product separation, deacidification, and catalytic upgrading while segregating the product separation section into lower and higher pressure sections. For example, vapor deacidification and catalytic upgrading are conducted downstream of a first compression stage, at generally lower pressures than the light hydrocarbon absorber stage, which follows a second compression stage. The process also includes a central debutanizer separator which collects liquid streams from various flash zones throughout the integrated process, and may optionally include a depropanizer to separate unreacted light hydrocarbons from a debutanizer overhead recycle stream.

The present process comprises three processing stages: a first catalytic cracking stage, a second intermediate product fractionation stage, and a third light aliphatics upgrading reaction stage. The first catalytic cracking stage comprises any suitable catalytic cracking configuration, as described more fully hereinbelow. The second stage fractionates and purifies the $C_9-$intermediate product streams from the catalytic cracking process to prolong catalyst life in the downstream aliphatics upgrading stage, to achieve the desired purity both in the fuel gas and in the finished products. The aliphatics upgrading stage may comprise aromatization or oligomerization.

The Catalytic Cracking Stage

In the first stage of the present process, a heavy hydrocarbon feedstock, for example, a gas oil, is cracked to a lighter product slate including distillates, gasoline, and $C_4-$aliphatics. The fluid catalytic cracking (FCC) process is most preferred for this first stage and has become well-established in the petroleum refining industry for converting higher boiling petroleum fractions into lower boiling products, especially gasoline.

Examples of catalytic cracking processes are taught in U.S. Pat. Nos. 2,383,636 to Wirth, 2,689,210 to Leffer, 3,338,821 to Moyer et al., 3,812,029 to Snyder, Jr., 4,093,537 to Gross et al., and 4,218,306 to Gross et al., as well as the disclosures of which are incorporated by reference as if set forth at length herein.

In the fluid catalytic process, a finely divided solid cracking catalyst is used to promote the cracking reactions which take place in the feed. The catalyst is used in a very finely divided form, typically with a particle size range of 20–300 microns, with an average of about 60–75 microns, in which it can be handled like a fluid (hence the designation FCC) and in this form it is circulated in a closed cycle between a cracking zone and a separate regeneration zone. In the cracking zone, hot catalyst is brought into contact with the feed so as to effect the desired cracking reactions after which the catalyst is separated from the cracking products which are removed from the cracking reactor to the associated fractionation equipment for separation and further processing. During the cracking reaction, coke is deposited on the catalyst. This deposit of coke masks the active sites and temporarily deactivates the catalyst. Such temporarily deactivated catalyst is commonly called spent catalyst. The catalyst must then be regenerated before it can be reused. Fortunately, the coke deposit can be made to serve a useful purpose. Cracking is an endothermic reaction. Although, in principle, heat could be supplied by raising the temperature of the hydrocarbon feed prior to contact with the catalyst, this would thermally crack the feed so that very little control could be effected over the product distribution. Additionally, the coke formed would deposit on furnace tubes and other equipment used for heating and conveying the feed to the cracker, causing operational problems. For this reason, it is generally preferred to supply the heat to the cracking reaction by means of the catalyst. The feed may, however, be preheated to a certain degree in order to maintain an appropriate heat balance in the cycle.

Heat for the catalytic cracking process is supplied by the regeneration step in which the spent catalyst is subjected to oxidatively regenerated to remove the coke. This coke-burning step is strongly exothermic and raises the regenerated catalyst temperature such the sensible heat imparted to the catalyst during regeneration is sufficient to supply the endothermic heat of reaction for the cracking step.

The regeneration takes place in a separate regenerator vessel. Catalyst is maintained in a fluidized bed in a lower section of the regenerator vessel and an oxygen-containing gas, usually air, flows through a distribution grid which is designed to provide efficient mixing of air with the spent, coked catalyst. During the regeneration step, the coke on the spent catalyst is oxidized and the heat from the oxidation is transferred to the catalyst to raise its temperature to the requisite level for continuing the cracking reactions. The hot, freshly-regenerated catalyst is then returned to the cracking zone for contact with further feed together with any recycle. Thus, the catalyst circulates continuously in a closed cycle between the cracking zone and the regenerating zone with heat for the endothermic cracking reactions being supplied in the regenerator by oxidative removal of the coke deposits which are laid down during the cracking portion of the cycle. In order to maintain the desired level of catalyst activity and selectivity, a portion of the circulating inventory of catalyst may be withdrawn intermittently or continuously with fresh, make-up catalyst being added to compensate for the withdrawn catalyst and the catalyst losses which occur through attrition and loss of catalyst from the system.

A further description of the catalytic cracking process and the role of regeneration may be found in the monograph, "Fluid Catalytic Cracking With Zeolite Catalysts", Venuto and Habib, Marcel Dekker, New York, 1978. Reference is particularly made to pages 16–18, describing the operation of the regenerator and the flue gas circuit. For additional details of FCC operation, see U.S. Pat. Nos. 2,383,636 to Wirth, 2,689,210 to Leffer, 3,338,821 to Moyer et al., 3,812,029 to Snyder, Jr., 4,093,537 to Gross et al., and 4,218,306 to Gross et al., the disclosures of which are incorporated by reference as if set forth at length herein.

A particularly preferred FCC configuration is disclosed in U.S. Pat. No. 4,840,928 to Harandi and Owen which teaches a fluid catalytic cracking (FCC) process in which catalyst withdrawn from the regenerator is cooled by direct contact with an alkane-rich stream in an external catalyst cooler, and is incorporated by reference as if set forth at length herein for a detailed description of a fluid catalytic cracking process. Details of FCC operation, and particularly the details of separating the fluidized catalyst from the reaction products are also taught in U.S. Pat. Nos. 4,043,899 to Anderson, 4,404,095 to Haddad, 4,502,947 to Haddad, 4,579,716 to Krambeck, 4,581,205 to Schatz, 4,588,558 to Kam, 4,606,814 to Haddad, 4,623,446 to Haddad, 4,624,772 to Krambeck, 4,654,060 to Haddad, U.S. Pat. No. 4,737,346 to Haddad, an 4,749,471 to Kam, which are incorporated by reference as if set forth at length herein.

Multistage Gas Compression

The present process integrates deacidification and catalytic upgrading steps between at least two compression stages in a catalytic cracking process product fractionation section. The term "multistage compressor" as used herein designates either a single compressor assembly with a plurality of compression stages, for example a multistage centrifugal compressor with a common shaft, or a series of physically separate compressor assemblies, for example two or more single stage compressors operatively connected in series, with the outlet of a first compressor feeding the suction inlet of a downstream compressor.

Interstage Deacidification

Following initial separation steps, a vapor stream containing acid gases such as $H_2S$ and $CO_2$ is deacidified by contacting the stream with an acid sorbent. This step preferably comprises countercurrently contacting the acid-containing vapor stream with an alkanolamine acid gas sorbent, for example, as described in U.S. Pat. No. 4,795,565 to Yan. The Yan reference describes a process for removing heat stable salts from an ethanolamine system by the use of ion exchange resins. The disclosure of U.S. Pat. No. 4,795,565 to Yan is incorporated herein by reference for the operating details both of an ethanolamine acid gas sorption system as well as for the heat stable salt removal process.

The Light Aliphatics Upgrading Stage

The process of the present invention upgrades the purified intermediate $C_2$–$C_4$ product stream via a zeolite-catalyzed light aliphatics upgrading process, e.g., aromatization or oligomerization.

The $C_4$—aliphatic hydrocarbons may be catalytically converted to longer chain oligomers or may be dehydrocyclized to aromatics, depending on the catalyst and process conditions selected. For example, metal-containing catalysts and more severe conversion conditions favor dehydrocyclization to aromatics (hereinafter referred to as aromatization or M-2 FORMING) Suitable conversion conditions are shown below in Table 1.

TABLE 1

| | Olefinic Gasoline Upgrading Reaction Process Conditions | | | |
|---|---|---|---|---|
| | Oligomerization | | Aromatization | |
| WHSV | Broad Range: | 0.3–20 $hr^{-1}$ | Broad Range: | 0.3–300 $hr^{-1}$ |
| | Preferred Range: | 0.5–5.0 $Hr^{-1}$ | Preferred Range: | 1–10 $hr^{-1}$ |
| Operating Pressure | Broad: | 240–2170 kPa (20–300 psig) | Broad: | 170–2170 kPa (10–300 psig) |
| | Preferred: | 790–1480 kPa (100–200 psig) | Preferred: | 310–790 kPa (30–100 psig) |
| Operating Temperature | Broad: | 340–540° C. (650–1000° F.) | Broad: | 540–820° C. (1000–1500° F.) |
| | Preferred: | 316–427° C. (600–800° F.) | Preferred: | 560–620° C. (1050–1150° F.) |

Aromatization

The following representative U.S. patents exemplify the feed compositions and process conditions for aliphatics aromatization reactions compatible with the final stage of the present process.

U.S. Pat. No. 3,756,942, incorporated by reference as if set forth at length herein, discloses a process for the preparation of aromatic compounds in high yields which involves contacting a particular feed consisting essentially of mixtures of paraffins and/or olefins, and/or naphthenes with a crystalline aluminosilicate, e.g. ZSM-5, under conditions of temperature and space velocity such that a significant portion of the feed is converted directly into aromatic compounds.

U.S. Pat. No. 3,759,821, incorporated by reference as if set forth at length herein, discloses a process for upgrading catalytically cracked gasoline.

U.S. Pat. No. 3,760,024, incorporated by reference as if set forth at length herein, teaches a process for the preparation of aromatic compounds involving contacting a feed consisting essentially of $C_2$–$C_4$ paraffins and/or olefins with a crystalline aluminosilicate, e.g. ZSM-5.

The article "M2 Forming-A Process for Aromatization of Light Hydrocarbons" by N.Y. Chen and T.Y. Yan, 25 IND. ENG. CHEM. PROCESS DES. DEV. 151 (1986) discusses the mechanisms of dehydrogenation and aromatization and is incorporated by reference as if set forth at length herein, but is not presented to limit the invention by theory.

Oligomerization

The final aliphatics upgrading stage may also comprise olefins interconversion or oligomerization. This process is commonly known as the Mobil Olefins to Gasoline/Distillate/Lubricants Process (MOG/-MOGD/MOGDL). Operating details for typical MOGD units are disclosed in U.S. Pat. Nos. 4,456,779; 4,497,968 to Owen et al. and 4,433,185 to Tabak, which are incorporated herein by reference.

In the process for catalytic conversion of olefins to heavier hydrocarbons by catalytic oligomerization using an acid crystalline zeolite, such as ZSM-5, process conditions can be varied to favor the formation of either gasoline, distillate or lube range products. At moderate temperature and relatively high pressure, the conversion conditions favor distillate range product having a normal boiling point of at least 165° C. (330° F.). Lower olefinic feedstocks containing $C_2$–$C_5$ alkenes may be converted selectively; however, the low severity distillate mode conditions cannot completely convert the fraction of ethene in the feed. Propene, butenes and others may be converted to the extent of more than 95% per pass in the distillate mode.

In the MOGD process, light olefins are oligomerized to high molecular weight distillate range olefins over ZSM-5. In that process olefin molecular weight growth through a sequence of oligomerization and cracking reactions is thermodynamically forced at relatively high pressures of about 5600 kPa (800 psia) and relatively low temperatures of about 260° C. (500° F.). At much lower pressure, thermodynamics restrict the olefin distribution to low molecular weight. This is the basis for the olefin interconversion process, i.e., to operate under conditions where lower olefins, such as $C_2$–$C_4$ olefins can be converted to an equilibrium distribution of olefins with butenes and pentenes maximized. While providing redistribution or interconversion of olefins, it has been discovered that under such interconversion conditions lower oxygenates, such as methanol, are also converted to olefins in the presence of ZSM-5 catalyst when the reaction temperature is above 204° C. (400° F.). Thus the most preferred embodiment of the etherification stage described above, MOEG, includes an olefin interconversion reaction.

The olefin interconversion process as utilized in the present invention can use fixed bed, moving bed or fluid bed reactors containing zeolite type catalysts such as ZSM-5. Operating conditions encompass temperatures between 200° and 400° C. and low pressures, generally between 100 and 500 kPa.

Catalysts

The catalysts useful in conjunction with the present process include composite catalysts containing at least one medium-pore zeolite, i.e., a zeolite having a Constraint Index of from about 1 to about 12, as described below. While referred to herein as aromatization catalysts, it is to be understood that these catalysts also effect olefin oligomerization under less severe process conditions. With respect to the preferred aromatization catalysts in the instant invention, recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolytic framework. These medium pore zeolites are favored for acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer et al.), incorporated herein by reference. The M-2 Forming catalyst can have the structure of ZSM-5 or a metal-containing ZSM-5 such as Ga-ZSM-5 or Pt-ZSM-5.

The shape-selective medium pore metallosilicate catalysts preferred for use herein include the crystalline aluminosilicate and/or gallosilicate zeolites having a silica to alumina molar ratio of at least 12, a constraint index of about 1 to 12, and acid cracking activity (alpha value) of at least 20, preferably about 50–300. Representative of such zeolites are ZSM-5, ZSM-11, ZSM-12, ZSM-21, ZSM-23, ZSM-35, ZSM-48, and MCM-22, and other similar materials.

ZSM-11 is more particularly described in U.S. Pat. No. 3,709,979, the entire contents of which is incorporated herein by reference. ZSM-12 is more particularly described in U.S. Pat. No. 3,832,449, the entire contents of which is incorporated herein by reference. ZSM-23 is more particularly described in U.S. Pat. No. 4,076,842, the entire contents of which is incorporated herein by reference. ZSM-35 is more particularly described in U.S. Patent No. 4,016,245, the entire contents of which is incorporated herein by reference. ZSM-48 and the conventional preparation thereof is taught by U.S. Pat. 4,375,573, the disclosure of which is incorporated herein by reference. MCM-22 and the conventional preparation thereof is taught by U.S. Pat. 4,954,325 the disclosure of which is incorporated herein by reference.

A suitable shape selective medium pore catalyst for the conversion of light aliphatics to aromatics is a small crystal HZSM-5 zeolite with a silica:alumina ratio of 70:1 and an alumina binder in the form of crystal extrudates of about 1–5 MM. Unless otherwise stated in this description, the catalyst shall consists essentially of ZSM-5, which has a crystallite size of about 0.02 to 0.05 micron.

An important characteristic of the crystal structure of the zeolites for use herein is that they provide constrained access to, and egress from, the intracrystalline free space by virtue of having a pore dimension greater than about 5 Angstroms and pore windows of about a size such as would be provided by a 10-membered ring of oxygen atoms. It is to be understood, of course, that these rings are formed by the regular disposition of tetrahedra making up the anionic framework of the crystalline aluminosilicates, the oxygen atoms themselves being bonded to the silicon or aluminum atoms at the center of the tetrahedra. Briefly, the preferred type catalysts useful in this invention possess, in combination: a silica-to-alumina ratio of at least about 12; and a structure providing constrained access to the crystalline free space.

The silica-to-alumina ratio referred to may be determined by conventional analysis. This ratio is meant to represent, as closely as possible, the ratio in the rigid anionic framework of the zeolite crystal and to exclude aluminum in the binder or in cationic or other forms within the channels. Although catalysts with a silica-to-alumina ratio of at least 12 are useful, it is preferred to use catalysts having higher ratios of about 20:1 to 200:1, preferably about 30–70:1.

Constrained access to the crystalline free space of zeolite catalysts is measured by the determination of a "Constraint Index." Catalysts suitable for the present invention are those having a constraint index in the approximate range of 1 to 12, as determined by the test procedure of U.S. Pat. No. 4,016,218, incorporated in its entirety herein by reference.

The light aliphatic hydrocarbon conversion process to form aromatics, "M-FORMING", may utilize conversion conditions described in U.S. Pat. No. 3,760,024 (Cattanach); 3,845,150 (Yan and Zahner); 4,097,367 (Haag et al.); 4,350,835 (Chester et al.); 4,590,323 (Chu); and 4,629,818 (Burress) incorporated herein by reference. A feedstream consisting essentially of $C_2$–$C_4$ paraffins and/or olefins (ethane, propane, butane, ethylene, propylene, butene, isobutylene, isobutane and mixtures thereof) is contacted with a zeolite catalyst under conversion conditions recited in Table 1, above. The aromatics which are produced are predominantly $C_6$–$C_{10}$ aromatics. The reactor system may be a fluid bed or tubular M-2 Forming or a moving bed system.

Process Flow

Referring now to the Figure, one embodiment of the present invention is illustrated. A mixed liquid and vapor overhead stream containing gasoline and lighter components from a main fractionation column of a catalytic cracking product separation section is charged via line 10 to main column overhead accumulator 20. The main column overhead accumulator typically comprises a single vessel, and accordingly provides a single flash zone. However, the accumulator may suitably comprise more than one stage if necessary to split the mixed vapor/liquid feedstream into a vapor overhead stream enriched in $C_4$−components and a bottom stream enriched in $C_5$+components.

Vapor rich in $C_4$−components flows upwardly from accumulator 20 through line 22 and enters a first compression stage 30 where pressure is increased from within the range of about 15 to about 45 psig to the range of from about 100 to about 150 psig, typically around 120 psig. The compressed gas stream, enriched in $C_4$−hydrocarbons, cools to a temperature of from about 80° to about 120° F., typically around 100° F., and is partially condensed in interstage cooler 40. The vapor-liquid mixture from interstage cooler 40 flows through line 42 to a first low temperature separator 50. The liquid stream from main column overhead accumulator 20, on the other hand, is withdrawn from a lower portion of the accumulator 20 through line 24 which is equipped with pump 26 and enters line 54 as shown.

Vapor enriched in $C_4$−hydrocarbons flows overhead from the first low temperature separator 50 through line 52 to a deacidification zone, shown in the Figure as a sorption tower 60. The sorption tower 60 countercurrently contacts an acid sorbent, for example, an alkanolamine, with the acid-containing light aliphatic gas to sorb acid constituents, e.g. $H_2S$, $CO_2$, or both, from the gas. The details of operating such an alkanolamine gas sorption system are disclosed in U.S. Pat. No. 4,795,565 to Yan, cited above. Briefly, an alkanolamine-water solution enters the top of sorption tower 60 through line 62 and flows downwardly through the tower, becoming enriched with acid gas, and is withdrawn from the bottom of the tower through line 64. The deacidified hydrocarbon vapor stream flows overhead from sorption tower 60 through line 66. If an optional intermediate compression stage is employed to boost pressure upstream of the catalytic reaction zone, the deacidified hydrocarbon vapor stream must enter a knockout drum 70 or other suitable means to prevent entrained liquid carryover from the sorption tower 60 to the intermediate compression stage 80. Vapor from knockout drum 70 flows through line 72 to the suction of the optional compression stage 80, while any accumulated liquid from knockout drum 70 flows to through line 74. The optional intermediate compression stage 80 is then followed by an intermediate compression stage aftercooler 90 which cools and may at least partially condense the compressed vapor, which then enters intermediate compression stage accumulator 100 where the vapor/liquid mixture readily separates. The liquid phase is enriched in $C_5$+gasoline and flows from a lower section of accumulator 100 through line 102 to debutanizer 200. The vapor phase withdrawn from accumulator 100, enriched in $C_4$−hydrocarbons, flows from an upper section of accumulator 100 via line 105 where it is joined by recycled $C_4$−hydrocarbons withdrawn from debutanizer 200 through line 202 before flowing through feed/effluent exchanger 110 and entering the bottom of reactor 120, which is schematically illustrated as a fluid bed reactor, but may comprise any suitable catalytic reactor configuration, including fixed as well as moving bed reactors. If a fluid bed reaction zone is employed, the reactor apparatus includes means for separating the finely divided catalyst from hydrocarbon products. Examples of such separation devices include cyclone separators and sintered metal filters. Cyclone separators (not shown) would typically be located near the top of reactor 120. The Figure shows a sintered metal filter 125 in reactor outlet line 122. Alternatively, both a cyclone separator and a sintered metal filter may be used.

Reactor effluent flows through line 122 to reactor effluent cooler 110, which preferably comprises a plurality of feed/effluent preheat exchangers in parallel, and the partially cooled reactor effluent continues through line 114 to reactor effluent cooler 130, which may comprise either a plurality of shell-and-tube water cooled heat exchangers in parallel or one or more air cooled exchangers in parallel. Generally, the feed/effluent preheat exchanger and reactor effluent coolers may be of any suitable configuration having total heat duty sufficient to cool the reactor effluent stream to temperatures of from about 80° to about 120° F., typically about 100° F. If the composition of the light aliphatic feed to the reactor is suitably balanced between olefins and paraffins as taught in U.S. Pat. No. 3,845,150 to Yan ad Zahner, the upgrading reaction may require no additional feed preheat other than that derived from the reactor effluent stream. However, due to varying feed compositions and other operational variations, it may be desirable to provide an auxiliary heat source such as a process furance (not shown) upstream of reactor 120 or heat exchange coils (also not shown) positioned within reactor 120. The cooled reactor effluent stream then enters reactor effluent accumulator 140 which separates the liquid product from unreacted vapors.

Second compression stage 150 increases the pressure of the vapor stream flowing from line 142 from an inlet pressure of around 80 psig, typically around 250 psig. The compressed vapor stream from second compression stage 150 flows through line 152 to compressor aftercooler 160 where it is cooled and partially condensed. Compressor aftercooler 160 is substantially similar in configuration to coolers 40 and 90, described above, and may be of any suitable configuration, including, for example, a water cooled shell-and-tube heat exchanger or a forced air cooled exchanger having extended surface area, i.e., a fin-fan cooler.

Cooled vapor is withdrawn from compressor aftercooler 150 and charged to a fifth accumulator which separates a vapor stream enriched in $C_4-$hydrocarbons flowing through overhead line 172 from a liquid stream enriched in $C_5+$normally liquid hydrocarbons flowing through line 174. The $C_4-$vapor stream is charged to a primary absorbed 180 while the $C_5+$normally liquid hydrocarbons are recycled to debutanizer 200 for recovery as liquid product.

In the presently described embodiment, the debutanizer tower 200 collects product from each of the hydrocarbon accumulation stages and fractionates these predominately liquid streams into an overhead stream enriched in $C_3$-$C_4$ hydrocarbons and a bottom stream containing $C_5+$gasoline. The debutanizer tower bottom stream, withdrawn through line 204, must meet a maximum vapor pressure specification which is largely a function of $C_4-$content, but the overhead stream is either recycled to be catalytically upgraded or is charged to a depropanizer (not shown) via lien 204 to further separate a depropanizer bottom stream rich in $C_4$ aliphatics from an overhead stream rich in propane/propene.

Normally liquid $C_5+$gasoline containing an aromatic fraction is withdrawn from the bottom of debutanizer tower 200 through line 204. A portion of the $C_5+$product is split off and flows through line 206 which is equipped with pump 208 and gasoline cooler 210. The cooled gasoline stream then enters absorber/stripper 180 near the top and flows downward through the tower, countercurrently contacting a light hydrocarbon gas stream entering absorber/stripper through line 172 near the bottom of the tower. The downwardly flowing gasoline stream absorbs $C_3+$hydrocarbons from the light hydrocarbon gas stream, flows from the bottom of absorber/stripper 180 through line 184 and pump 190, and enters line 152 upstream of aftercooler 160.

To remove residual $C_5+$hydrocarbons from the overhead vapor stream withdrawn from primary absorber 180 through line 186, the overhead vapor stream may optionally be charged to a sponge absorbed 210 where the vapor stream countercurrently contacts a heavier liquid hydrocarbon stream, for example, a light cycle oil from the main product fractionation column (not shown). The light cycle oil stream is charged to an upper section of sponge absorber 210 through line 212 and flows downwardly through the sponge absorber, becoming enriched in $C_5+$components entrained in the vapor stream. The lean vapor stream is then withdrawn from the top of sponge absorber 210 through line 214 while the enriched cycle oil is returned to the main column (not shown) via line 216 for further processing.

Turning now to the debutanizer feedstreams, each of accumulators 20, 50, 100, 140, and 170, in the present embodiment evolve liquid containing varying amounts of $C_5+$gasoline produce. These streams are charged to the debutanizer 200, primarily to adjust the $C_4-$content before the resulting gasoline product is blended into a motor fuel.

Liquid product from main column overhead accumulator 20 flows through line 24 and pump 26 into line 54 where it is joined by liquid product from the first low temperature separator 50. The combined liquid flows through line 54 and may be partially refluxed to the main column (not shown) through reflux line 56. Remaining liquid flows through pump 220 and gasoline cooler 230 before being charged to a lower tray of debutanizer 200.

Liquid withdrawn from the optional intermediate compression stage accumulator 100 flows through line 102 while liquid withdrawn from reactor effluent accumulator 140 flows to debutanizer 200 via line 144. The combined liquid streams are fractionated as described above to evolve a debutanizer bottom stream containing both cracked gasoline from the catalytic cracking process as well as oligomerized and/or aromatized gasoline boiling range product from the reaction of $C_4-$aliphatics in reactor 120.

Changes and modifications in the specifically described embodiments can be carried out without departing from the scope of the invention which is intended to be limited only by the scope of the appended claims.

What is claimed is:

1. A method for improving the gasoline product yield in a catalytic cracking process comprising the steps of:

(a) catalytically cracking a hydrocarbon feedstock containing gas oil or heavier fractions to a cracked product stream containing distillate, gasoline, lighter boiling range hydrocarbon fractions, and $H_2S$, $CO_2$, or both $H_2S$ and $CO_2$;

(b) providing a product fractionation section for separating and recovering gasoline and lighter components from said product stream, said product fractionation section including a primary cracked product separation zone, a multistage compressor, and a central debutanizer separator;

(c) flowing a stream containing cracked gasoline and lighter boiling hydrocarbons withdrawn from an upper section of said primary cracked product separation zone to a first accumulation zone to provide a vapor stream enriched in $C_4-$cracked hydrocarbons containing $H_2S$, $CO_2$, or both $H_2S$ and $CO_2$, and a liquid stream enriched in $C_5+$hydrocarbons;

(d) compressing said vapor stream of step (c) in a first stage of said multistage compressor of step (b) to evolve a deacidification charge stream;

(e) deacidifying said deacidification charge stream of step (d) by countercurrently contacting said vapor deacidification charge stream in a first sorption zone with an acid sorbent whereby said acid sorbent becomes enriched in $H_2S$, $CO_2$, or both $H_2S$ and $CO_2$;

(f) withdrawing a deacidified stream enriched in $C_4-$cracked hydrocarbons from said first sorption zone and flowing said deacidified stream to a second accumulation zone;

(g) contacting a deacidified vapor stream withdrawn from said second accumulation zone of step (f) with a catalyst comprising a zeolite under conversion conditions to convert $C_4-$cracked hydrocarbon products to a reactor effluent stream containing gasoline boiling range constituents including aromatics;

(h) cooling and at least partially condensing said reactor effluent stream and flowing said cooled reactor effluent stream to a third accumulation zone;

(i) compressing a vapor stream withdrawn from said third accumulation zone in a second stage of said multistage compressor of step (b);

(j) cooling said second stage compressor effluent of step (i) to at least partially condense said second stage compressor effluent;

(k) flowing said at least partially condensed second stage compressor effluent to a fourth accumulation zone to separate said at least partially condensed second stage compressor effluent into a vapor stream enriched in $C_3-$components and a liquid stream containing $C_4+$components;

(l) charging liquid product streams from said first accumulation zone, said second accumulation zone, said third accumulation zone, and said fourth accumulation zone to said central debutanizer separator to separate said liquid product streams into a central debutanizer overhead stream enriched in $C_4-$components and a bottom stream enriched in $C_5+$gasoline boiling range components; and (m) flowing a portion of said central debutanizer bottom stream to a second sorption zone to countercurrently sorb and remove $C_3+$components from said fourth accumulation zone overhead stream of step (l) and recycling said sorbed $C_3+$components to said fourth accumulation zone.

2. The method of claim 1 wherein said zeolite of step (g) has a Constraint Index of from about 1 to about 12.

3. The method of claim 2 wherein said zeolite has the structure of at least one selected from the group consisting of ZSM-5, ZSM-11, ZSM-12, ZSM-22, ZSM-23, ZSM-35, ZSM-48, and MCM-22.

4. The method of claim 3 wherein said zeolite contains gallium.

5. A method for improving the gasoline product yield in a catalytic cracking process comprising the steps of:

(a) catalytically cracking a hydrocarbon feedstock containing gas oil or heavier fractions to a cracked product stream containing distillate, gasoline, lighter boiling range hydrocarbon fractions, and $H_2S$, $CO_2$, or both $H_2S$ and $CO_2$;

(b) providing a product fractionation section for separating and recovering gasoline and lighter components from said product stream, said product fractionation section including a primary cracked product separation zone, a multistage compressor, and a central debutanizer separator;

(c) flowing a stream containing cracked gasoline and lighter boiling hydrocarbons withdrawn from an upper section of said primary cracked product separation zone to a first accumulation zone to provide a vapor stream enriched in $C_4-$cracked hydrocarbons containing $H_2S$, $CO_2$, or both $H_2S$ and $CO_2$, and a liquid stream enriched in $C_5+$hydrocarbons;

(d) compressing said vapor stream of step (c) in a first stage of said multistage compressor of step (b);

(e) cooling said first stage compressor effluent of step (d) to at least partially condense said first stage compressor effluent;

(f) flowing said at least partially condensed first stage compressor effluent to a second accumulation zone to provide a vapor deacidification charge stream containing $H_2S$, $CO_2$, or both $H_2S$ and $CO_2$, and a second accumulation zone liquid stream enriched in $C_4+$hydrocarbons;

(g) deacidifying said vapor deacidification charge stream of step (f) by countercurrently contacting said vapor deacidification charge stream in a first sorption zone with an acid sorbent whereby said acid sorbent becomes enriched in $H_2S$, $CO_2$, or both $H_2S$ and $CO_2$;

(h) withdrawing a deacidified vapor stream enriched in $C_4-$cracked hydrocarbons from first sorption zone and flowing said deacidified vapor stream to a third accumulation zone;

(i) contacting at least a portion of said deacidified vapor stream with a catalyst comprising a zeolite under conversion conditions to convert $C_4-$cracked hydrocarbon products to a reactor effluent stream containing gasoline boiling range constituents including aromatics;

(j) cooling and at least partially condensing said reactor effluent stream and flowing said cooled reactor effluent stream to a fourth accumulation zone;

(k) compressing a vapor stream withdrawn from said fourth accumulation zone in a second stage of said multistage compressor of step (b);

(l) cooling said second stage compressor effluent of step (k) to at least partially condense said second stage compressor effluent;

(m) flowing said at least partially condensed second stage compressor effluent to a fifth accumulation zone to separate said at least partially condensed second stage compressor effluent into a vapor stream enriched in $C_3-$components and a liquid stream containing $C_4+$components;

(n) charging liquid product streams from said first accumulation zone, said second accumulation zone, said fourth accumulation zone, and said fifth accumulation zone to said central debutanizer separator to separate said liquid product streams into a central debutanizer overhead stream enriched in $C_4-$components and a bottom stream enriched in $C_5+$gasoline boiling range components;

(o) flowing a portion of said central debutanizer bottom stream to a second sorption zone to countercurrently sorb and remove $C_3+$components from said fifth accumulation zone overhead stream of step (m) and recycling said sorbed $C_3+$components to said fifth accumulation zone; and (p) recycling at least a portion of said central debutanizer overhead stream to said catalytic conversion step (i).

6. The process of claim 5 wherein said zeolite of step (i) has a Constraint Index of from about 1 to 12.

7. The process of claim 6 wherein said zeolite has the structure of at least one selected from the group consisting of ZSM-5, ZSM-11, ZSM-12, ZSM-22, ZSM-23, ZSM-35, ZSM-48, and MCM-22.

8. The process of claim 7 wherein said zeolite contains gallium.

9. A method for improving the gasoline product yield in a catalytic cracking process comprising the steps of:

(a) catalytically cracking a hydrocarbon feedstock containing gas oil or heavier fractions to a cracked product stream containing distillate, gasoline, lighter boiling range hydrocarbon fractions, and $H_2S$, $CO_2$, or both $H_2S$ and $CO_2$;

(b) providing a product fractionation section for separating and recovering gasoline and lighter components from said product stream, said product fractionation section including a primary cracked product separation zone, a multistage compressor, and a central debutanizer separator;

(c) flowing a stream containing cracked gasoline and lighter boiling hydrocarbons withdrawn from an upper section of said primary cracked product separation zone to a first accumulation zone to provide a vapor stream enriched in $C_4-$cracked hydrocarbons containing $H_2S$, $CO_2$, or both $H_2S$ and $CO_2$, and a liquid stream enriched in $C_5+$hydrocarbons;

(d) compressing said vapor stream of step (c) in a first stage of said multistage compressor of step (b);

(e) cooling said first stage compressor effluent of step (d) to at least partially condense said first stage compressor effluent;

(f) flowing said at least partially condensed first stage compressor effluent to a second accumulation zone to provide a vapor deacidification charge stream containing $H_2S$, $CO_2$, or both $H_2S$ and $CO_2$, and a second accumulation zone liquid stream enriched in $C_4+$hydrocarbons;

(g) deacidifying said vapor deacidification charge stream of step (f) by countercurrently contacting said vapor deacidification charge stream in a first sorption zone with an acid sorbent whereby said acid sorbent becomes enriched in $H_2S$, $CO_2$, or both $H_2S$ and $CO_2$;

(h) withdrawing a deacidified vapor stream enriched in $C_4-$cracked hydrocarbons from first sorption zone and flowing said deacidified vapor stream to a third accumulation zone;

(i) contacting a deacidified vapor stream withdrawn from said third accumulation zone of step (h) with a catalyst comprising a zeolite under conversion conditions to convert $C_4-$cracked hydrocarbon products to a reactor effluent stream containing gasoline boiling range constituents including aromatics;

(j) cooling and at least partially condensing said reactor effluent stream and flowing said cooled reactor effluent stream to a fourth accumulation zone;

(k) compressing a vapor stream withdrawn from said fourth accumulation zone in a second stage of said multistage compressor of step (b);

(l) cooling said second stage compressor effluent of step (k) to at least partially condense said second stage compressor effluent;

(m) flowing said at least partially condensed second stage compressor effluent to a fifth accumulation zone to separate said at least partially condensed second stage compressor effluent into a vapor stream enriched in $C_3-$components and a liquid stream containing $C_4+$components;

(n) charging liquid product streams from said first accumulation zone, said second accumulation zone, said fourth accumulation zone, and said fifth accumulation zone to said central debutanizer separator to separate said liquid product streams into a central debutanizer overhead stream enriched in $C_4-$components and a bottom stream enriched in $C_5+$gasoline boiling range components;

(o) flowing a portion of said central debutanizer bottom stream to a second sorption zone to countercurrently sorb and remove $C_3+$components from said fifth accumulation zone overhead stream of step (m) and recycling said sorbed $C_3+$components to said fifth accumulation zone; and (p) recycling at least a portion of said central debutanizer overhead stream to said catalytic conversion step (i).

10. The process of claim 9 wherein said zeolite of step (i) has a Constraint Index of from about 1 to about 12.

11. The process of claim 10 wherein said zeolite has the structure of at least one selected from the group consisting of ZSM-5, ZSM-11, ZSM-12, ZSM-22, ZSM-23, ZSM-35, ZSM-48, and MCM-22.

12. The process of claim 11 wherein said zeolite contains gallium.

* * * * *